United States Patent [19]

Israels et al.

[11] 4,220,091

[45] Sep. 2, 1980

[54] DELAY FUZE FOR EXPLOSIVE CHARGE

[75] Inventors: Sylvan H. Israels, Morris Plains; Stephan Kosonocky, Whippany, both of N.J.

[73] Assignee: The United States of America as represented by the Secretary of the Army, Washington, D.C.

[21] Appl. No.: 883,023

[22] Filed: Mar. 3, 1978

[51] Int. Cl.[2] ..... F42B 15/02; F42B 15/36

[52] U.S. Cl. ..... 102/64; 102/256; 102/255

[58] Field of Search ..... 102/64, 229, 233, 244, 102/254, 255, 256

[56] References Cited

U.S. PATENT DOCUMENTS

| | | | |
|---|---|---|---|
| 2,872,866 | 2/1959 | Brown et al. | 102/255 |
| 3,313,236 | 4/1967 | Lohmann | 102/256 |
| 3,340,810 | 9/1967 | DiPaola | 102/64 |

*Primary Examiner*—Verlin R. Pendegrass
*Attorney, Agent, or Firm*—Nathan Edelberg; Robert P. Gibson; A. Victor Erkkila

[57] ABSTRACT

An explosive hand grenade comprises a hollow spherical shell having a single opening surrounded by a tubular hub, a tubular housing threaded into the hub and extending into the shell, a barrier plate with an eccentric hole closing the inner end of the housing, booster cup attached to the housing and extending beyond the plate to form a booster charge cavity, a rotatable mandrel in the housing, next to the barrier plate, having an eccentric passage therethrough out of alignment with the barrier plate hole in a first position, a bushing fixed in the housing, next to the mandrel, having a passage aligned with the mandrel passage, a unitary combustible delay cord extending through both passages and preventing rotation of the mandrel, an igniter and a striker therefor for igniting the end of the cord remote from the barrier plate, manually-releasable means for initially preventing rotation of the mandrel and operation of the striker until the grenade is thrown, and a torsion spring for rotating the mandrel, after the cord has burned to the junction of the two passages, from the first position to a second position aligned with the barrier plate hole, to initiate the booster charge.

5 Claims, 7 Drawing Figures

DELAY FUZE FOR EXPLOSIVE CHARGE

GOVERNMENTAL INTEREST

The invention described herein may be manufactured, used and licensed by or for the government for governmental purposes without payment to us of any royalty thereon.

BRIEF SUMMARY OF THE INVENTION

The present invention relates to delay fuzes for explosive devices, and particularly for hand grenades.

In accordance with the invention, an explosive device is provided with a novel delay fuze including a housing, a barrier plate having an eccentric hole at one end of the housing, a first member fixed in the housing, spaced from the barrier plate, having a first elongated passage out-of-line with the barrier plate hole, a second member in the housing, between the barrier plate and the first member, having a second elongated passage aligned in a first position with the first passage and movable to a second position in alignment with the barrier plate hole, a unitary combustible delay cord extending through both passages and initially preventing relative movement of the two members, means for igniting the end of the cord remote from the barrier plate, and spring means for moving the second member to the second position after the cord has burned to the junction of the two passages.

DETAILED DESCRIPTION OF THE INVENTION

Figure 2:
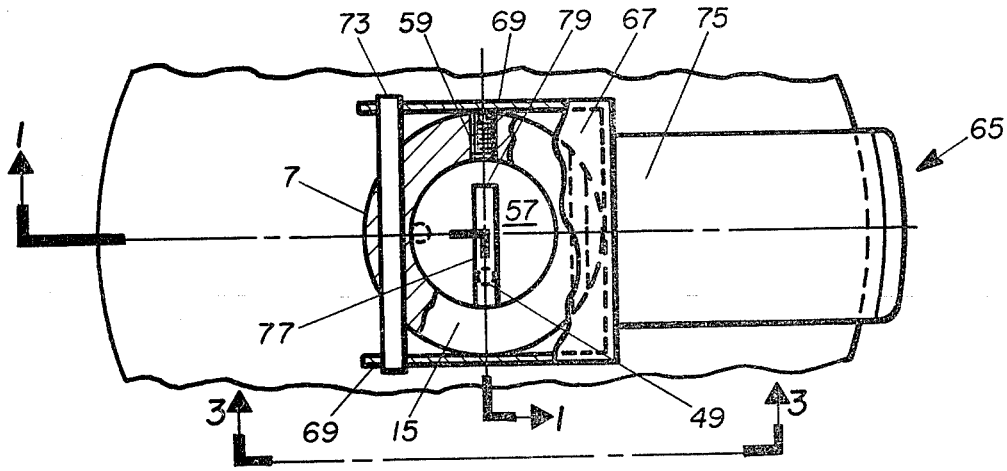
FIG. 2 is a top plan view of a portion of the grenade of FIG. 1.
Figure 1:
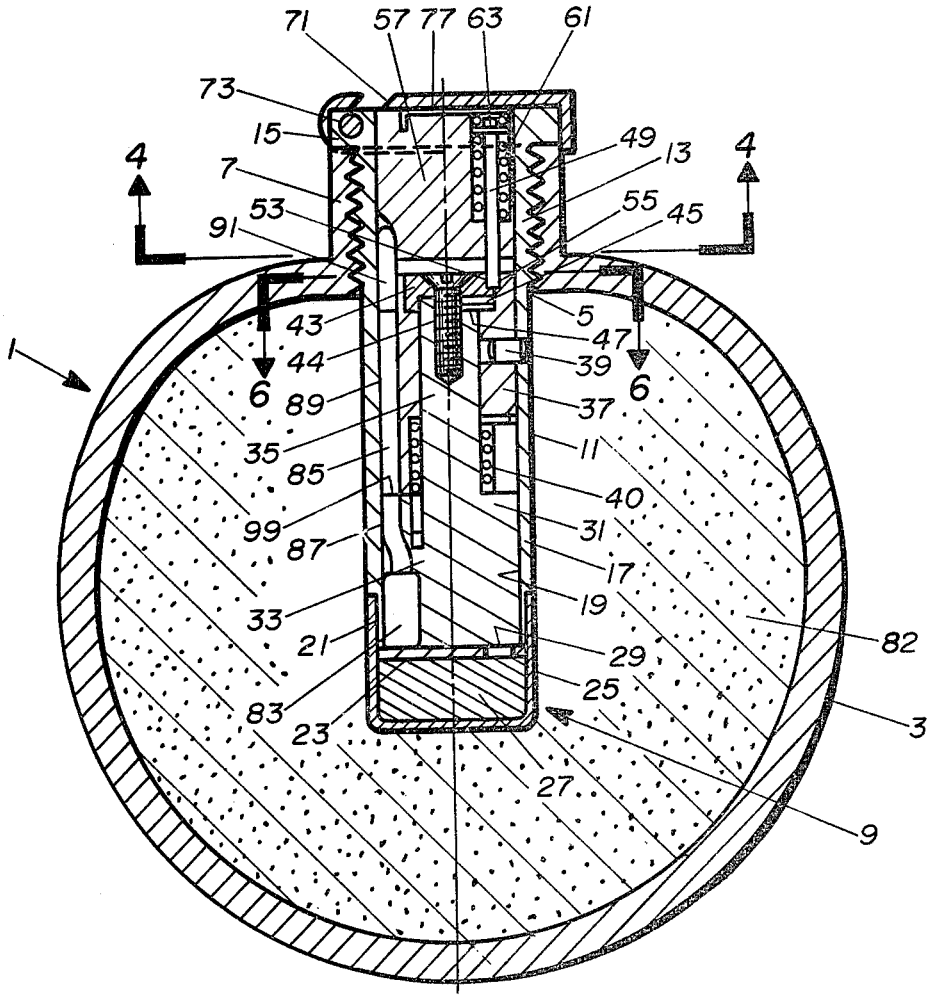
FIG. 1 is an axial section view, taken along the angled line 1—1 of FIG. 2, of a hand grenade embodying the present invention.
Figure 3:
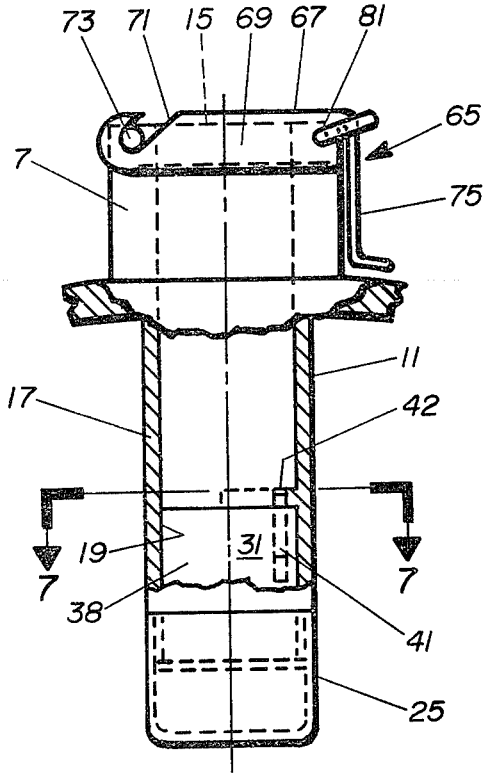
FIG. 3 is a side view, partially cut-away, of the fuze of FIG. 1.

FIGS. 1 through 7 illustrate a hand grenade 1 embodying an example of the present invention. Grenade 1 comprises a hollow shell 3, which may be generally spherical, as shown in FIG. 1, having a single opening 5, surrounded by an outwardly-extending, internally-threaded hub 7. A generally cylindrical delay fuze 9 embodying the invention is axially mounted in the opening 5.

Figure 7:
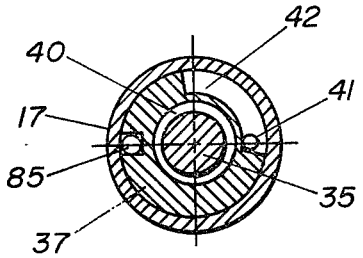
FIG. 7 is a transverse section view taken along the line 7—7 of FIG. 3.
Figure 5:
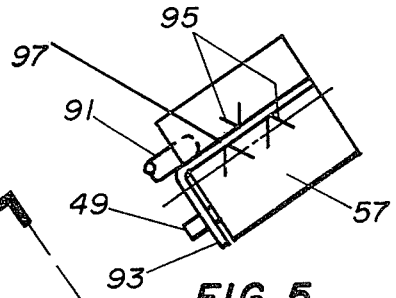
FIG. 5 is a side elevation view of FIG. 4, taken in the direction 5—5.
Figure 6:
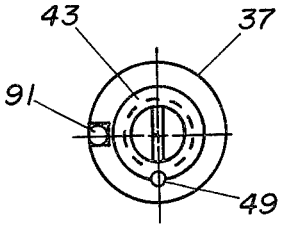
FIG. 6 is a transverse section view taken along line 6—6 of FIG. 1.
Figure 4:
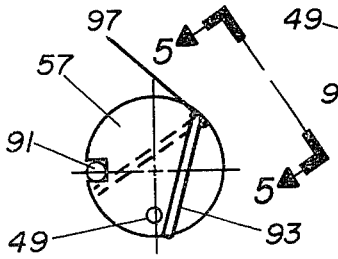
FIG. 4 is a transverse section view of a central portion of the fuze of FIG. 1 taken on line 4—4.

Fuze 9 includes a tubular housing 11 comprising an externally-threaded outer portion 13 threaded into the hub 7 and terminating in a flange 15, and an inner portion 17. The inner surfaces of parts 13, 15 and 17 constitute a continuous cylindrical bearing surface 19. The inner end of portion 17 is reduced in diameter at 21 and closed by a transverse barrier plate 23 and a booster charge cup 25 to form a booster charge cavity 27 therebetween. Barrier plate has a single eccentric hole 29, located on the right side in FIG. 1. Contiguous to the barrier plate 23 is a mandrel 31 comprising a cylindrical inner end 33 rotatable in the tubular portion 17, in bearing 19, and a reduced cylindrical extension 35. The extension 35 extends through and also rotates in a bushing 37 which is fixed within the tubular portion 17 by a pin 39. The mandrel is biased to rotate counter-clockwise relative to the bushing 37 by a torsion spring 40. As shown in FIG. 7, this rotation is limited to about 90° by an axial pin 41 in the mandrel and an arcuate groove 42 in the bushing 37. A flange plate 43 is attached to the end of extension 35 by a screw 44 and keyed with a radial pin 45 in the plate engaging a radial notch 47 in the extension 35. Prior to firing the grenade, rotation of plate 43 with respect to the bushing 37 is prevented by an axial safing pin 49, the inner end of which engages two mating semi-cylindrical grooves 53 and 55 in the plate and bushing. The safing pin 49 extends through a cylindrical body 57 held in the hub 7 by a screw 59. Pin 49 is biased outwardly by a spring 61 recessed into body 57 and engaging a flange 63 on the pin, and held in locking position, against spring 61, by a manually-held safety spoon 65. The spoon 65 comprises a top plate 67 having two side flanges 69 detachably hinged by angled slots 71 and a dowel pin 73 mounted in hub flange 15, and a handle 75. A detachable safety pin 81 may be used to lock the spoon 69 to the flange 15. The travel of safing pin 49 is restricted by a pin stop leaf spring 77 which is staked at 79 to the outer face of body 57. The space between the shell 3 and the fuze 9 is filled with high explosive material 82.

The firing train of the fuze comprises a detonator 83 housed in the mandrel 31 on the left side of FIG. 1, which is angularly displaced from the barrier plate hole 29 by 90° (with the angled section line 1—1). A unitary elongated lead-cased PDC (pyrotechnic delay cord) 85 extends from the detonator 83, through aligned passages 87 and 89 in the mandrel 31 and bushing 37, to an igniter or flash stem 91, such as a "Magicube", located near the body 57. The igniter 91 is initiated, after release of the spoon 69 and safety pin 81, by a cocked spring wire striker 93 (see FIGS. 4 and 5) which is staked at 95 in a groove 97 in the body 57.

In operation, the spoon handle 79 is manually held against the grenade shell 3 while the safety pin 81 is removed, and the grenade is then thrown at the target in the usual manner. Upon release of the handle 79, the spoon is removed by the pin 49 and its spring 61. As the pin 49 moves outward, it releases the plate 43 an mandrel 31 for rotation, and simultaneously releases the cocked striker 93 to ignite the flash stem 91, which in turn starts the combustion of the PDC 85. Rotation of the mandrel 31 by the torsion spring 40 is prevented by the body of the PDC 85 until the latter burns therealong to the junction of the mandrel 31 and the bushing 37, in the transverse plane 99. The PDC 85 disintegrates at plane 99, allowing the spring 40 to rotate the mandrel 31 through 90°, which aligns the burning inner portion of PDC 85 and the detonator 83 with the barrier plate hole 29, thereby initiating the booster charge 27 a predetermined delay time after the grenade is thrown.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. A delay fuze comprising:

an explosive charge to be initiated;

a barrier plate adjacent to said charge, having an access opening therethrough;

a body spaced from and fixed with respect to said barrier, having a first elongated passage therethrough out of alignment with said opening;

an arming member extending between said barrier and said body, having a second elongated passage therethrough; said arming member being movable between a safe position wherein said passages communicate with each other and an armed position wherein said second passage communicates with said opening;

an elongated metal encased unitary combustible element disposed in said passages and initially holding said arming member in said safe position;

means for igniting the end of said combustible element remote from said arming member to start a delay firing reaction therealong; and means for moving said arming member to said armed position when said member is released by the burning of said combustible element and melting of the metal case thereof at the junction of said passages, to effect communication between said element and said opening.

2. A delay fuze for a hand grenade, comprising:

a tubular support adapted to be assembled to a hand grenade housing;

a booster charge fixed in the inner end of said support for initiating the grenade charge;

a barrier plate fixed in said support adjacent to said booster charge, having an eccentric opening therethrough;

an arming rotor adjacent to said plate and rotatable in said support between safe and armed positions, said arming rotor having a first eccentric longitudinal passage therethrough angularly displaced from said plate opening in safe position but aligned with said opening in armed position;

torsion spring means biasing said arming rotor toward said armed position;

a detonator in the inner end of said first passage;

a bushing fixed in said support adjacent to said rotor, having a second eccentric longitudinal passage therethrough aligned with said first passage in the safe position;

an explosive initiator within and extending beyond the outer end of said second passage;

a metal encased unitary combustible delay cord extending between said initiator and said detonator in said passages, the portion of said cord at the junction of said passages holding said rotor in the safe position, against said torsion spring means, prior to combustion thereof; and means for exploding said initiator immediately after said grenade is thrown;

whereby, when said cord portion burns and melts the metal case thereof, said torsion spring rotates said rotor to the armed position, and said detonator initiates said booster charge through said opening in said barrier plate.

3. A hand grenade fuze as in claim 2, wherein:

said initiator is impact sensitive; and said means for exploding said initiator comprises:

a cocked striker arranged to strike said initiator when released;

a locking pin which contacts and holds said arming rotor in a safe position and said striker in cocked position;

spring means biasing said pin toward disengagement from said striker; and a manually-held safety arm preventing movement of said pin prior to throwing said grenade.

4. A hand grenade fuze as in claims 1 or 2, wherein the metal of said case is low melting temperature lead.

5. A hand grenade fuze as in claim 3, wherein the cocked striker is a spring wire, which travels transversely to strike the initiator.

* * * * *